US006948786B1

(12) United States Patent
Chung

(10) Patent No.: US 6,948,786 B1
(45) Date of Patent: Sep. 27, 2005

(54) FURNITURE HAVING COMPOUND FOLDABLE PARTS

(75) Inventor: Donna Chung, Bangkok (TH)

(73) Assignee: Collins International Co. Ltd., Fair Lawn, NJ (US)

( * ) Notice: Subject to any disclaimer, the term of this patent is extended or adjusted under 35 U.S.C. 154(b) by 8 days.

(21) Appl. No.: 10/607,104

(22) Filed: Jun. 25, 2003

Related U.S. Application Data

(60) Provisional application No. 60/441,393, filed on Jan. 21, 2003.

(51) Int. Cl.[7] ..... A47B 43/00; A47B 3/00

(52) U.S. Cl. ..... 312/257.1; 312/259; 312/263; 312/258; 108/115

(58) Field of Search ..... 312/257.1, 258, 312/259, 261, 262, 263, 208.1; 108/115

(56) References Cited

U.S. PATENT DOCUMENTS 242,355 A * 5/1881 Nicholas ..... 217/16
2,764,462 A * 9/1956 McDonald ..... 312/140.2
3,009,752 A * 11/1961 Margulis ..... 312/280
3,837,719 A * 9/1974 Barron ..... 312/195
5,568,773 A * 10/1996 Hung ..... 108/50.02
5,769,514 A 6/1998 Brown et al. ..... 312/195
5,882,098 A * 3/1999 Brown et al. ..... 312/258
5,997,113 A 12/1999 Benson ..... 312/195
6,041,723 A 3/2000 Peterson ..... 108/115
6,158,831 A * 12/2000 Brown et al. ..... 312/258
6,350,092 B1 * 2/2002 Powell ..... 411/82
6,722,750 B2 * 4/2004 Chan ..... 312/258

* cited by examiner

*Primary Examiner*—Peter M. Cuomo
*Assistant Examiner*—Sarah C. Burnham
(74) *Attorney, Agent, or Firm*—C. Nessler

(57) ABSTRACT

A furniture article suited for shipment in a compact carton has a top, a back hinged from the rear edge of the top, opposing side panels hinged from the back, and means for holding the opposing side panels in position, such as a stretcher bar, or a shelf hinged from the back to fold down and engage the side panels. A table particularly useful for computer use has a middle panel, a fold down shelf hinged from the middle panel, and drawers. When a wedge and pocket fastener is used in combination with the factory attachment of hinges, the articles can be assembled by a consumer at the point of use, without the use of tools or screws or bolts.

10 Claims, 6 Drawing Sheets

FURNITURE HAVING COMPOUND FOLDABLE PARTS

This application claims benefit of provisional patent application Ser. No. 60/441,393, filed Jan. 21, 2003.

TECHNICAL FIELD

The present invention relates to furniture, in particular tables and bookcases, which is shipped in compact form, for assembly the consumer.

BACKGROUND

Since articles of furniture tend to be bulky and costly to ship in the assembled condition, it is common to design and fabricate such items in knock down form. That is, the furniture is designed so that it is made up of sub-components, which when packed together, fit into a relatively compact shipping container. The consumer assembles the furniture at the point of use. And, preferably, the furniture might be knocked down again for storage.

Numerous different designs and assembly concepts are known in the prior art. However, differences in execution of the design and manufacture can make a substantial difference to the consumer. Among the criteria that characterize a good piece of furniture are the following. The article must be have a desired and pleasing esthetic appearance when assembled. The article must function for the desired purpose; typically, it must be strong and durable. The parts should fit together easily, and assembly should involve a minimum of tools and skill. Manufacturing should not demand extreme precision and cost should be low. The unassembled subcomponents should be sturdy and not prone to damage during rough shipment and handling. The carton into which the knock down table components are placed for shipment should be as compact as possible. It is not easy to meet all the foregoing criteria. Certain pieces of furniture have specialized requirements. For example, in tables used for computers, it is desirable to have a flat work surface, to hold the computer system components, particularly the monitor, and, to have at least one under-desk drawer, for holding a keyboard. That drawer ought to be closeable, to conceal the keyboard when it is not in use. It is also desirable to provide at least one shelf under the table for holding computer system components or related accessories, such as a printer. Sometimes the aforementioned parts of the computer system are heavy, and thus the table needs to be strong when assembled. Similarly, a book case has to be capable of bearing substantial weight, as does a rolling cart suited for a computer printer, a television or a microwave oven. Thus, while there has been a great variety of knockdown furniture in commerce, it has always been difficult to combine ease of assembly with strength and low cost.

SUMMARY

An object of the invention is to provide furniture, such as tables, carts and bookcases, preferably made of wood, which can be shipped in compact form, and then assembled by a consumer with no tools, or minimal use of tools. A further object is to meet the criteria, which are mentioned in the Background; especially to provide a strong furniture article capable of bearing significant loads which can be shipped in a compact flat carton.

In accord with the invention, a furniture article has a top, a back hinged from the top, and opposing side panels hinged from the back, and, thus the parts are compound foldable by virtue of the hinging. For shipment, the side panels fold onto the back, and the back then folds onto the underside of the top. Preferably, the side panels fold inwardly to the back, and when back is folded down, the side panels are between the back and the underside of the top. When such a compound-hinged article is assembled at the point of use, the back is lifted up from the top as the top lies on the floor. The end leg panels are rotated outwardly, toward stops/stiffeners on the underside of the top. Means, such as a folding shelf or a stretcher or the equivalent, hold the panels in their use position, so the panels support the front edge of the furniture article.

Preferably, when the top of the furniture article is deep, there is a stiffener running front-back across the underside of the top. And, when the side panels are folded inwardly onto the back, a gap is formed between the opposing ends of the folded-in end panels, thus providing a space for receiving the stiffener when the back and top are folded together.

Different furniture articles may embody the invention. In accord with the invention, a computer table further comprises a separate middle panel sub-assembly, a shelf and drawers. The middle panel slides into place, and is fastened to the underside of the top, preferably by means of a clever plastic wedge and pocket system. A shelf hinges down from the middle panel, so the outer end of the shelf attaches to the lower interior portion of the nearby end panel, using the wedge system. The attachment both provides the shelf with support for loads, and prevents inward rotation of the one end panel. A mid-point stretcher is then fastened in place, to run between the lower midpoint of the middle panel and the lower midpoint of the other end panel, away from the shelf. The mid-point stretcher prevents inward rotation of the other end panel, and provides general structural strength to the table. Optional drawers may be provided, for example for a keyboard. When assembled, the invention provides a table that has very good strength and functionality.

Other articles can have different combinations of stretchers and shelves. For example, a wheeled cart for a computer printer or other device has a fold down lower shelf and a slide-in upper shelf. Another table simply has a lower stretcher connecting the opposing end panels. A bookcase has three fold-down shelves.

A consumer can assemble furniture articles, made in accord with the preferred embodiments of the invention, quickly and easily without needing any tools. Yet, the articles are economical to manufacture; and, form a compact package for shipment. They do not demand that the consumer have patience and use tools, as is the case with prior art knock down furniture articles in general. The foregoing and other objects, features and advantages of the invention will become more apparent from the following description of preferred embodiments and accompanying drawings.

DESCRIPTION

The invention was previously described in provisional patent application Ser. No. 60/441,393, filed Jan. 1, 2003. The disclosure thereof is hereby incorporated by reference. The various embodiments of the invention described below are preferably made of finished wood, with metal hinges. Other materials of construction may be used.

A table 20, having features which make it particularly suited for users of computers, is first described. Other products, including a wheeled cart, suitable for holding such as a small computer printer or a television set or microwave oven, etc., is then described, along with a bookcase. The cart and bookcase have inventive features, similar to the table. It will thus be understood how still other furniture products comprising support legs and a top working surface, may embody the principles and feature of the invention.

Figure 1:
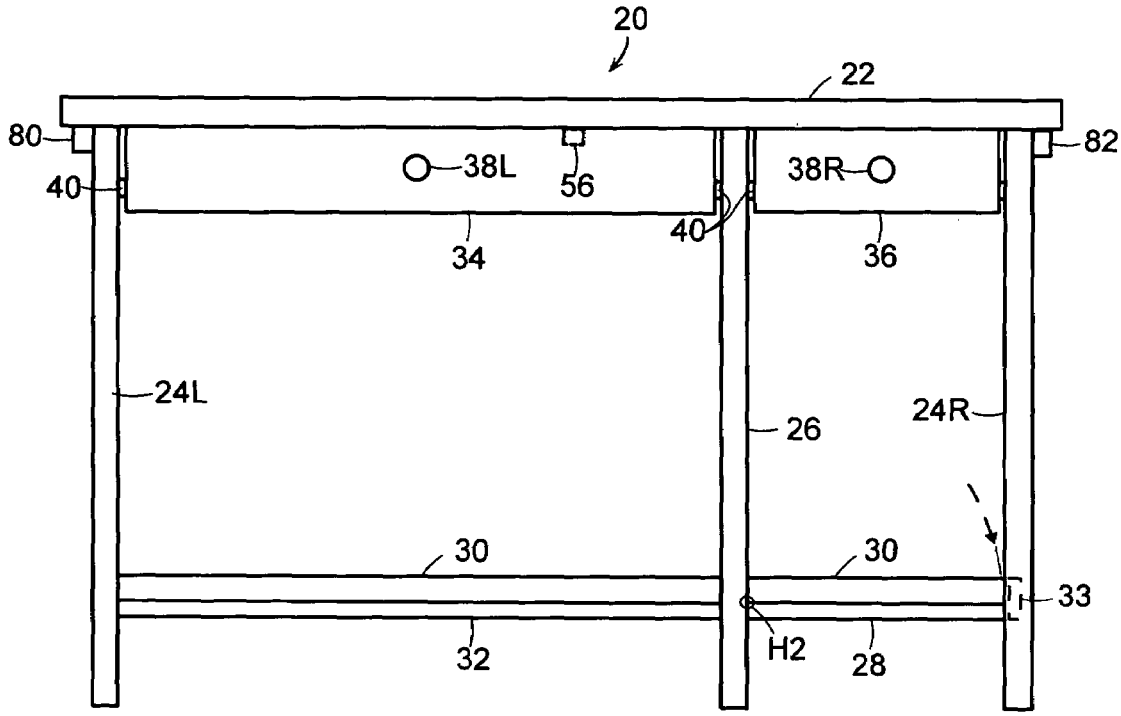
FIG. 1 is a front view of a table particularly suited for use with a computer system.
Figure 2:
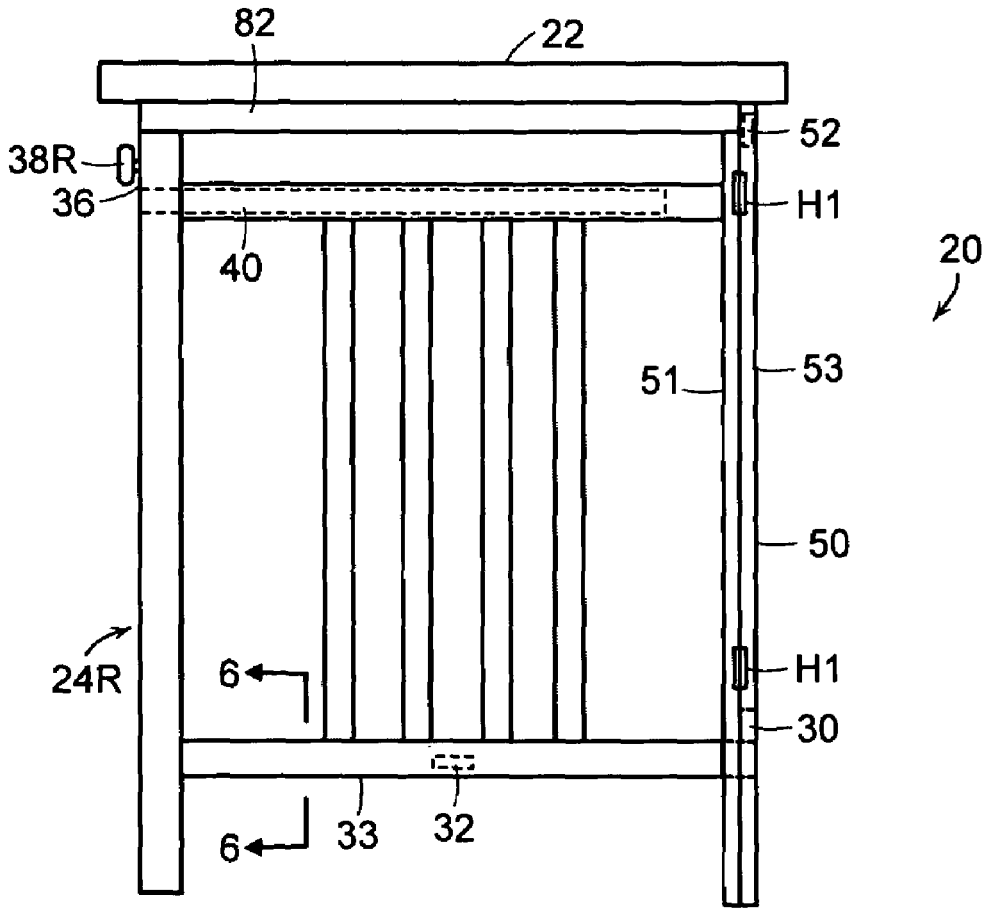
FIG. 2 is an elevation view of the right side of the table shown in FIG. 1.
Figure 3:
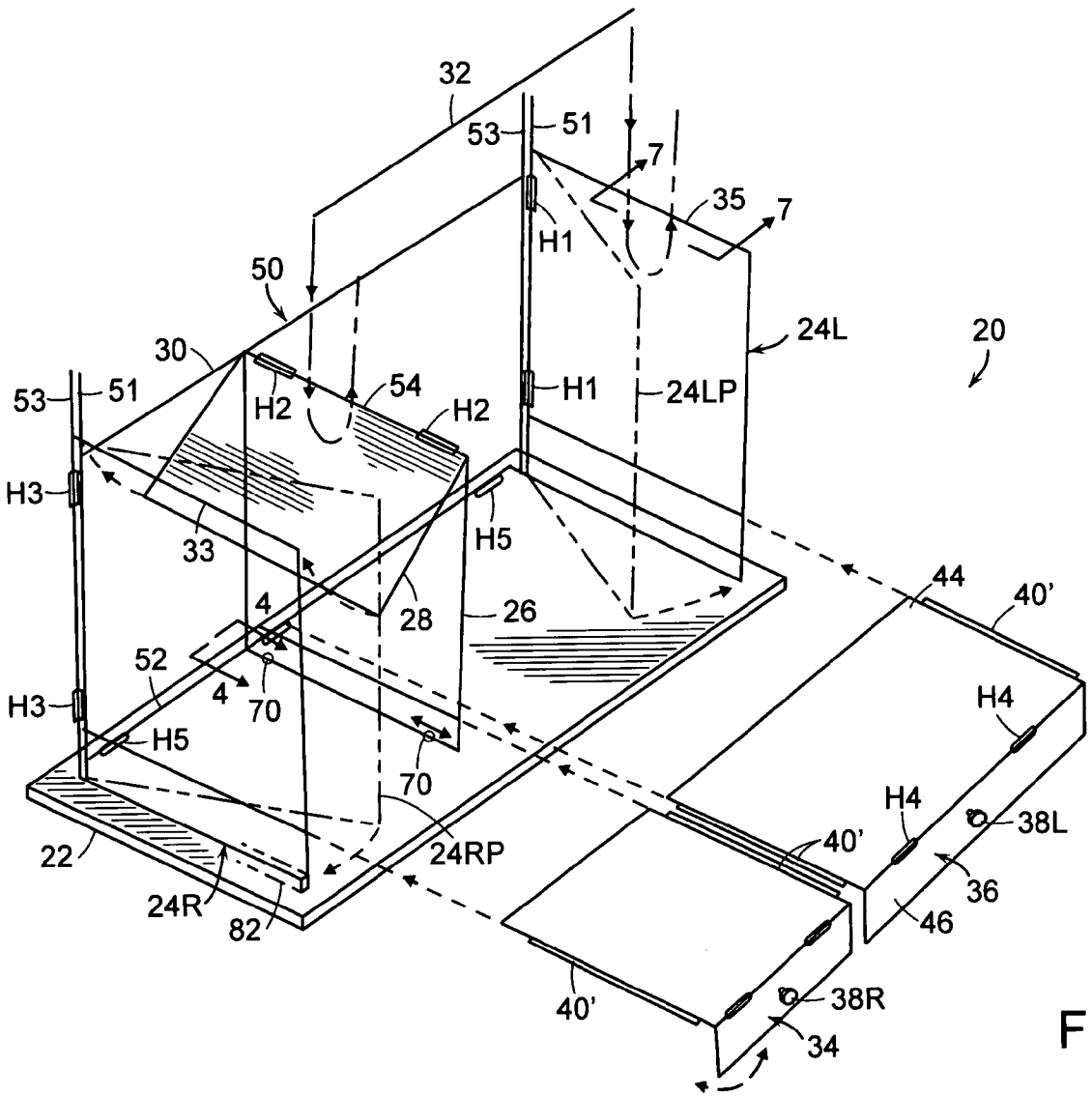
FIG. 3 is an exploded isometric view of the inverted table of FIG. 1, largely as a stick figure. How hinged parts swing for assembly is shown.
Figure 4:
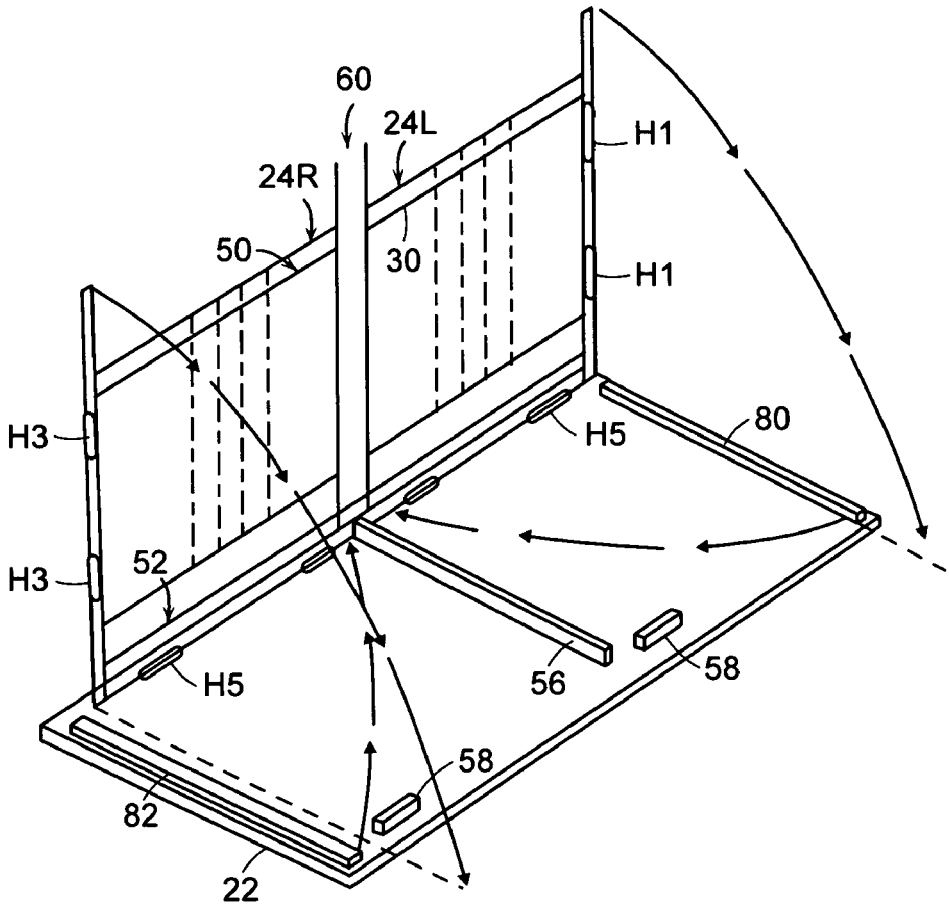
FIG. 4 is a view like FIG. 3, showing how the parts of the main assembly comprising the back, top and two end panels are hinged and how they fold together for shipment or storage, as a flat assembly.

FIG. 1 and FIG. 2 show in front and right side elevations, respectively, table 20. FIG. 3 shows table 20 lying inverted, with its top down, as does FIG. 4. FIGS. 3 and 4 are largely stick figures. That is, most of the different wooden parts are shown as sticks or lines of only length dimension.

FIG. 3 shows different sub-assemblies and components, and how they are assembled to form the table. It shows how, when the end panels 24L and 24R are folded in onto the back, the top and back fold together by means of hinges, to form a flat folded sub-assembly, with the side panels resting in the space between the top and the back.

For clarity of illustration some of the details shown in one Figure may not be shown in a corresponding Figure. FIGS. 3 to 8 show how various components are detachably fastened together. Hinges, designated by the letter H, connect several of the components. The parts, which are hinged, are preferably connected by the hinges at the factory, prior to placement of the resultant sub-assembly in the shipping container. A feature of the invention is that it permits the user to assemble and disassemble a piece of furniture without having to work with bolts or screws (other than for drawer pulls). In the generality of the invention, some bolts and screws may be used, as all the good features do not have to be used.

Referring now primarily to FIGS. 1, 2, 3 and 4, the assembled table is comprised of top 22, back 50 which runs left-right, and three leg assemblies, namely left side panel 24L, right side panel 24R, and middle panel 26, each running front-back. The middle panel 26 is offset to the right of the centerline in the preferred embodiment, it being understood that location can be varied within the scope of the invention.

As illustrated in FIG. 2 for the right panel, each panel has four slats running vertically between upper stretcher 40 and lower stretcher 33. The slats provide both structural strength and decorative appearance. Other strengthening and decorative means may be used. Each panel has legs which extend beyond the lower stretcher.

The back 50 has legs 53 which run parallel, in mating fashion, to the rear legs 51 of the side panels, where those panels are hinged connected to the back. Stretcher 30 which runs the full width of the back, between its two opposing end legs. The back is connected to the top by four hinges H5, so the back can fold onto the underside of the top.

The middle panel 26, to which is attached a hinged shelf 28, is a separate element. It slides into position, and is attached to the top by means of wedge fasteners, as described further below. When the middle panel is in position, centerline stretcher 32 runs between the center point of the lower end of the middle panel and a like place at the left side panel. Shelf 28 runs between the middle panel and the right leg panel. Shelf 28 is connected to middle panel 26 by hinge set H2, so it folds into position, to contact the right side panel 24R, as indicated by arrows in the various Figures.

Left drawer 34 and right drawer 36 are positioned underneath the table top 22. The drawers, shown upside down in FIG. 3, are constructed similarly. Each moves in and out by means of common metal track and roller glide assemblies 40, which are attached to the sides of the drawers and the adjacent panel part. As illustrated by FIG. 3, typical drawer 36 has no sides. Front panel 46 pivots down to a flat position by means of hinges H4, when the face 46 of the drawer is opened by pull 38L, making it suited to hold a computer keyboard. When the drawer is closed, the face is held in the vertical closed position by magnetic latch 58. Drawer 34 is constructed similarly to drawer 36.

Figure 12:
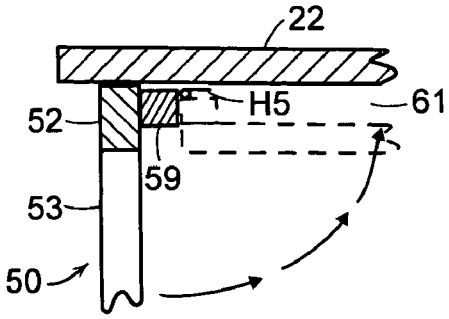
FIG. 12 is a vertical front-back cross section, from the left side, of the upper rear part of the table of FIG. 1, showing a detail of how the back is hinged to the top.

Hinges H5 connect the top to the back 50 in proximity to the rear edge. See FIG. 4. The left and right panels are hinged from the back 50 by hinge sets H1 and H3. FIG. 4 shows by means of arrows, how the four hinged components, the top, back, and two end panels, fold together, to form a flat assembly for shipment. Stiffener 56 is glued and or screwed, to run front-to-back along the nominal centerline of the underside of the top, to provide strength to the top. Note how, when the end panels 24L and 24R fold in on the back panel, there is a gap 60 between their ends. Thus, when the back panels then fold down onto the underside of the top, the gap provides a space for the stiffener 56, so the back panel, with the folded end panels, is folded to lie flat on the underside of the top. See FIG. 4. To allow space 61 for the folded down side panels, as shown in the partial cross section of FIG. 12, hinges H5 attach to the back 50 by means spacer blocks 59 fastened to the horizontally running top rail 52 of the back.

Figure 5:
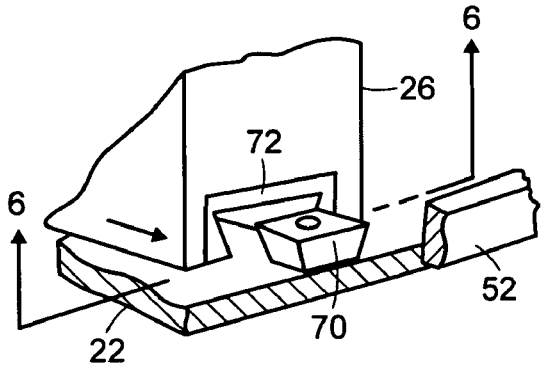
FIG. 5 is an end view of the top of the middle panel, from the rear side of a partially-cut-away and inverted top, to show one the wedge fastening means.
Figure 6:
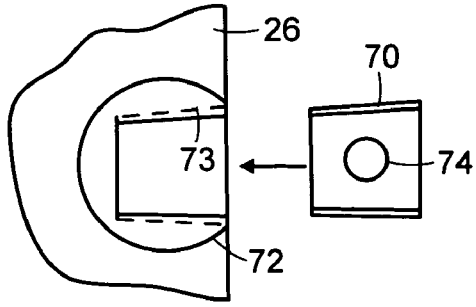
FIG. 6 is a partial view of the wedge and pocket fastener means, shown in FIG. 5, while looking down at the top of the middle panel.

FIG. 3, with reference to FIG. 4, shows how the table is assembled. The reverse of the folding together procedure, which was just described, is followed. When back 50 is put in the vertical position, relative to the horizontal upside down top 22, the side panels 24 rotate into position is indicated by arrows, and their upper ends support the front edge of the top and prevent downward hinge motion of the top. The outward motion of the side panels is limited by stops 80, 82, attached to the underside of the table top 22. The middle panel 26 then slips into position by sliding rearward, as indicated by arrow in FIG. 5. FIGS. 5 and 6 detail how the middle panel is attached to the top as it slides rearwardly, into position. The attachment means comprises two spaced apart plastic wedges 70, fastened to the underside of the top. The wedges are used elsewhere as well, and the use with the middle panel will be instructive of how they work in general. Wedge 70 has a hole 74, so it can be attached to a surface, in this case the underside of the table top, by a screw at the factory. Wedge 70 has compound angles, to engage similar angles in the pocket 73 of plastic insert 72, which is captured in the wood of the mating part, in this case, the top edge of the middle panel 26. The engagement of the wedge and pocket prevents further motion in the direction of the pocket bottom, in this case, rearward. And the engagement resists parting of the mated component surfaces, in this case downward motion of the middle panel. A slight interference fit of the resilient plastic members causes a positive engagement, or latching action, so that, force is required to slide the panel in the forward direction, as if to remove it from the table top.

Figure 7:
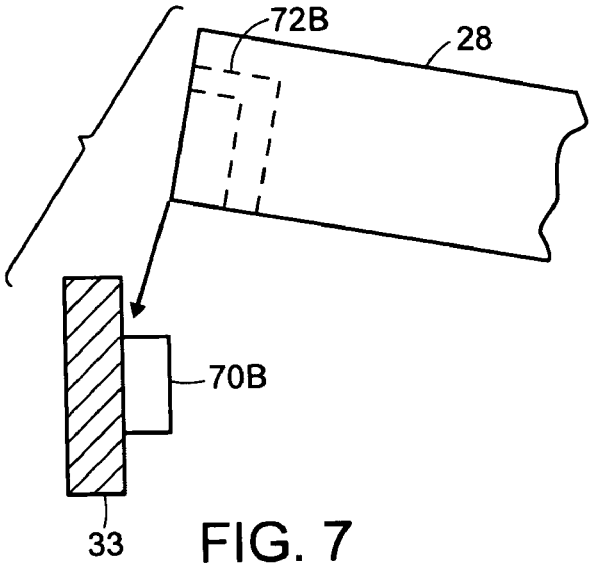
FIG. 7 is an elevation cross section view through the bottom rail of the right end panel, looking from the rear of the table, showing how the edge of the hinged shelf engages and is fastened to the stretcher.

After the middle panel has been slid into place, the shelf 28 is folded down. See FIG. 3 and FIG. 1. FIG. 7 is a rear cross section view of lower part of the right side panel. It shows that the outer end of shelf 28 has two spaced apart pocket inserts 72B, which engage wedges 70B mounted on the lower stretcher of right panel 24R. Thus, the lower ends of the right panel and the middle panel are connected and mutually supported. Inward rotation of the right panel is prevented.

Figure 8:
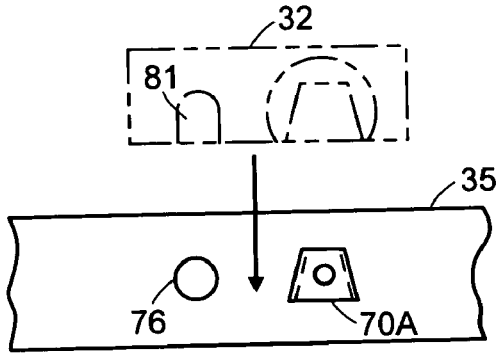
FIG. 8 is an elevation view showing the inside surface of the lower stretcher of the left end panel, and how it is engaged by the end of the mid-point stretcher.

Centerline stretcher 32 is then put in place, to connect the spaced apart bottom stretchers of the left side panel and middle panel. The arrows in FIG. 3 show the motion for installation. The stretcher runs parallel to the hinge line of the top and back. FIG. 8 details how left panel stretcher 35 connects to centerline stretcher 32. The connection of stretcher 32 to the center panel is similar. Wedge 70A and dowel pin 76 project from the surface of stretcher 32. The end of the stretcher 32, shown in phantom, has a plastic pocket, to receive the wedge, and it has a slot 81, to receive the dowel pin. The wedge provides the positive engagement vertically and lengthwise, while the dowel prevents rotation and resists downward force, as might be applied by a table user's feet resting on the stretcher 32. Stretcher 32 prevents inward rotation of the left side panel. The engagement of shelf 28 prevents rotational motion of the right side panel. Thus, the combination of shelf 28 and stretcher 32 comprise means for preventing the side panels from folding inwardly, and for tying together all the panels, when the table is assembled for use. When the table turned over to its use position, the drawers may be inserted in place, and the table will be ready for use.

In use, downward extending legs of the table support the load. Table 20 has 8 legs in contact with the floor, namely, two legs at each end panel, two for the middle panel and two for the back panel. Since the rear legs of the back panel are closely adjacent to the rear legs of the side panel, as shown in FIG. 2, the assembled table presents as having 6 legs. Legs, as the term is used herein, refer to the upwardly running structural members. In other embodiments, the legs may only extend to the lower stretcher, which may act as the base of the article. In still other embodiments, only some legs may extend to the floor. For instance, the legs 53 of the back may extend downwardly to the floor, while the mating rear legs 51 of the side panel may not extend so far, or vice versa.

Front to back "parallelogramming" of the three panels is prevented by the glued construction of the parts, including the slats. The factory-made rigidity of the glued back parts, including the top and bottom stretchers, in combination with the fold down shelf 28 and centerline stretcher provide good resistance to left-right motion of the table. Other bracing for strength may be added, within the scope of the invention. Conversely, if less strength is required, some of the bracing, slats, etc, which have been described may be eliminated. (For simplicity of illustration, such kinds of features are omitted from FIGS. 9–11, but they will be understood to be optionally present.)

The table is easy to assemble for a user and requires no tools, except perhaps to install the knobs for the drawer fronts. The table components all fold flat and stow compactly in a shipping carton. There are no bolts or other fittings, so the possibility of such parts being insufficient in number is eliminated.

While the absence of bolts or screws is a feature, in other embodiments of the invention, conventional bolt or screw fasteners may be used, in substitution of the convenient wedges and other fasteners, which have been described or suggested. Still other fasteners known in the art may be used, and use of glue for permanent assembly may be contemplated.

Figure 13:
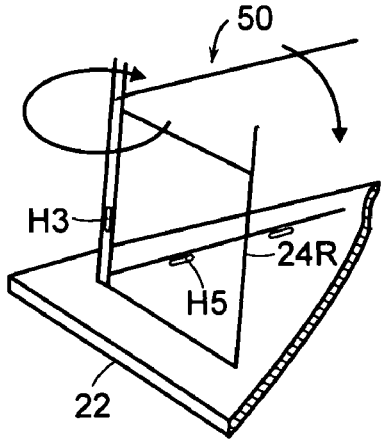
FIG. 13 shows a portion of a table embodiment, in fashion similar to FIG. 4, where the end panels swing outwardly, rather than inwardly before the back and top fold together.

In a preferred embodiment, the top is about 48 inches long by 24 inches wide and about 31 inches from the floor. The middle panel is about 16 inches from the right side panel. While the table is described as a computer table, because that is its primary intended use, the article may be employed for other purposes. The drawers may be eliminated. Conversely, other features, such as other drawers and more shelves may be added. For example, a table may have two fold down shelves, one from each side of the middle panel. And, a table may have more than one middle panel. In another embodiment, less preferred, table 20 may comprise left and right end panels which hinge outwardly from the back when the table is in assembled condition, as illustrated by FIG. 13. When folded together, the back will underlie the side panels.

Figure 9:
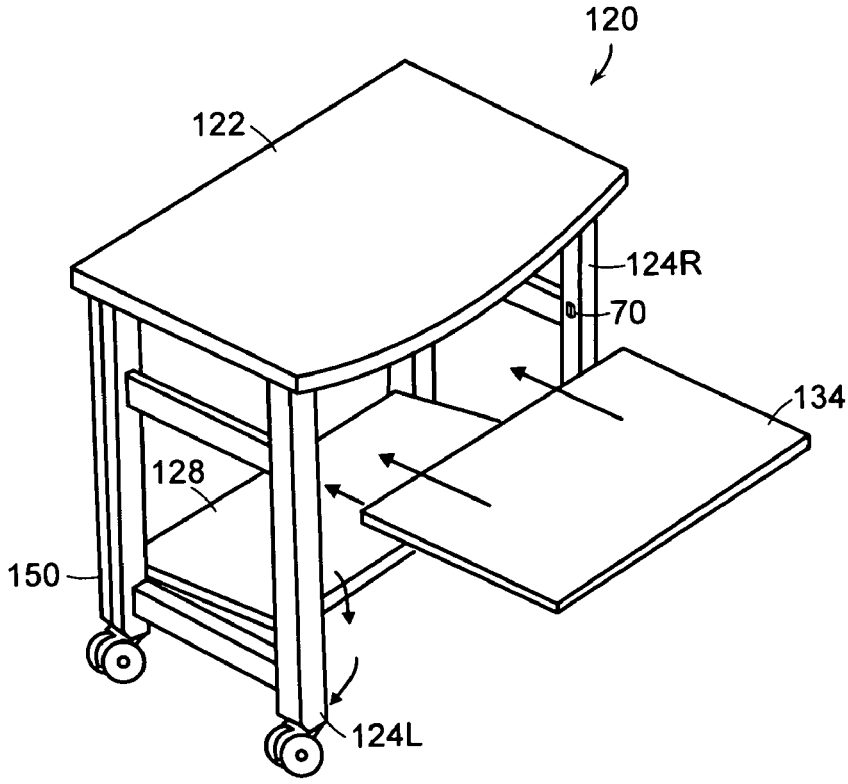
FIG. 9 is an isometric view of a rolling cart having two different kinds of shelves.
Figure 10:
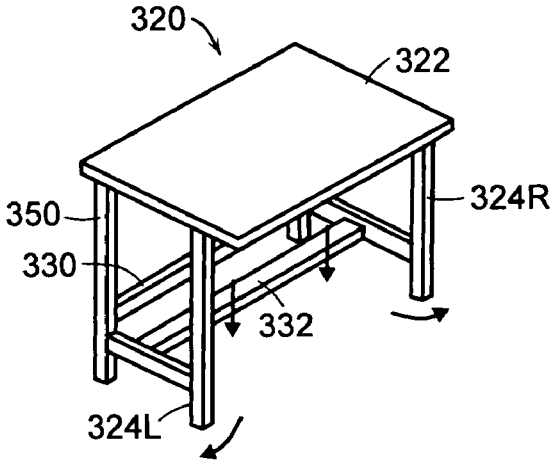
FIG. 10 is an isometric view of a small table having a stretcher connecting the opposing side panels.
Figure 11:
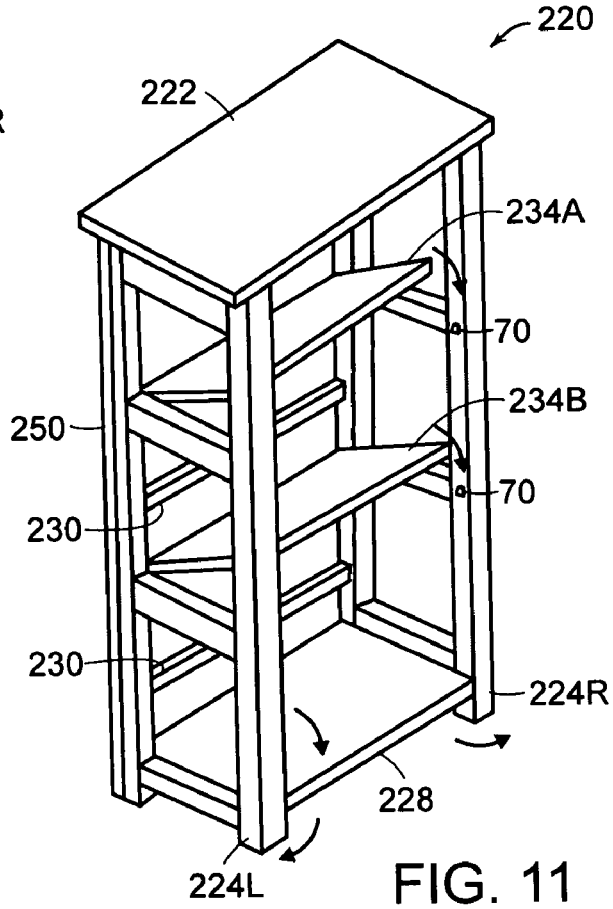
FIG. 11 is an isometric view of a bookcase having three shelves and a top.

FIGS. 9, 10 and 11 show examples of other articles embodying features like those just described. Parts of those articles which generally corresponding with features previously described have similar last two digits, with a different prefix. These articles each have six legs, although when assembled, they appear as if having four legs.

FIG. 9 shows a wheeled small cart having two shelves, suited for supporting a computer printer, a television set, a microwave oven, and similar kinds of things. The opposing side panels hinge outwardly from a back 150, which hinges from the top, all as previously described. The bottom shelf folds downwardly from the back, to engage wedges at the inside front end of stretchers of the side panels. Shelf 134 slides into place, and is attached to the opposing side panels 124L, 124R, at the elevation of their upper stretchers, by opposing side pairs of wedges 70.

FIG. 10 shows a small table where the opposing side panels 324R, 324L hinge outwardly from the folded down back 350, and the legs are held rotationally in place by centerline stretcher 332, which attaches to the stretchers of the opposing side panels by means similar to that use for stretcher 32 of table 20.

FIG. 11 shows a bookcase 220 having a top 222, suited for supporting books and other things. The opposing side panels

224R, 224L are hinged from the back 250 which is hinged from the top 222, in accord with prior descriptions. Three shelves 228, 234A and 234B fold down from the back 150 after the side panels have been rotated outwardly into position, to engage wedges 70 on the inside of the opposing side panels. The front-back depth of the legs of the back, and or the manner in which the side panels are hinged, are such as to provide sufficient space for the folded up shelves, and still enable the side panels for lie parallel to the top. That is also the case for the cart of FIG. 9. This approach is analogous to that discussed in connection with FIG. 12.

While the orthogonal arrangement of the top, sides and back is most familiar, within the generality of the invention, when assembled, the top may be sloped (and thus the side panels will be trapezoidal in shape). Alternatively, for special embodiments, the side panels may run at other than 90 degrees to the rear, and the shelves, stretchers or other means for preventing hinge motion of the assembly will be shaped accordingly. In a further variation, the principles of the invention will also be useful and applicable for products where the top or side panels are other than planar.

Although this invention has been shown and described with respect to one or more preferred embodiments, and by examples, those should not be considered as limiting the claims, since it will be understood by those skilled in this art that various changes in form and detail thereof may be made without departing from the spirit and scope of the claimed invention.

I claim:

1. An article of furniture, adapted for shipment in compact folded position and for use in assembled position, comprising:

a top having a front and a rear, edges at the front, rear and sides, a top side and an underside;

a back, connected to the top by hinges in proximity to the rear edge of the top, so the back folds downwardly from the underside of the top when the top is disposed horizontally, from a shipment position wherein the back is nominally parallel with the underside of the top, to an assembled position wherein the back is nominally perpendicular to the underside of the top;

opposing left and right side panels, each side panel having an upper end and a lower end, each panel connected by hinges to the back, wherein each panel folds outwardly from a shipment position in which the panel lies nominally parallel with the back to an assembled position wherein the panel is nominally perpendicular to back; wherein, after said back is folded downwardly from the top and the side panels are folded outwardly from the back, to assemble the article, the upper ends of the side panels support opposing side edges of top so they are in a horizontal plane;

a middle panel, running parallel to the side panels when the side panels are in their outwardly folded position, detachably attached to the top; and, means for preventing folding of the opposing side panels, when the article is in its assembled position, the means including a shelf, hinged from a side panel or the middle panel, wherein the shelf folds downwardly from the panel when the panel is vertically-disposed, from a shipment position wherein the shelf is nominally parallel with said panel, to an assembled position wherein the shelf is nominally perpendicular to said panel; the shelf connecting the middle panel and a side panel.

2. The article of claim 1 wherein the shelf is hinged from the middle panel; and wherein the opposing end of the shelf detachably fastens to the side panel to which the shelf connects when the article is in its assembled position.

3. The article of claim 2 wherein a wedge and pocket combination is used to detachably fasten the shelf to the side panel.

4. The article of claim 1 wherein means for preventing folding further comprises: a detachable stretcher connecting said middle panel with the other side panel, to which said shelf is not connected, when the article is in its assembled position.

5. The article of claim 4 wherein the means for connecting at least one end of the stretcher to said other side panel or said middle panel comprises a pin and slot in combination with a wedge and pocket assembly.

6. The article of claim 1 further comprising at least one stop, attached to the underside of the top near a side edge thereof, for limiting said outward folding of at least one side panel, when the side panel is moved outwardly to a position nominally perpendicular to the back, so the article is in its assembled position.

7. The article of claim 1, further comprising: a second shelf, detachably mounted above said hinged shelf, connecting said middle panel and the side panel to which the first shelf connects.

8. The article of claim 1 wherein there is a gap between the side panels when they lie parallel with the top and the article is in its shipment position; further comprising: a stiffener for the top, attached to the underside of the top, within said gap.

9. The article of claim 1, further comprising at least one drawer removably mounted beneath the top by means of opposing glide assemblies, one each attached to a middle panel and a side panel, when the article is in its assembled position.

10. The article of claim 9, adapted for use to hold a computer system, wherein said drawer has a downwardly pivotable front panel.

* * * * *